US009465331B2

(12) United States Patent
Imai et al.

(10) Patent No.: US 9,465,331 B2
(45) Date of Patent: Oct. 11, 2016

(54) IMAGE FORMING APPARATUS

(71) Applicants: Masakazu Imai, Kanagawa (JP); Tsutomu Kato, Kanagawa (JP); Naoki Iwaya, Tokyo (JP); Osamu Ichihashi, Kanagawa (JP)

(72) Inventors: Masakazu Imai, Kanagawa (JP); Tsutomu Kato, Kanagawa (JP); Naoki Iwaya, Tokyo (JP); Osamu Ichihashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/935,275

(22) Filed: Nov. 6, 2015

(65) Prior Publication Data

US 2016/0139543 A1 May 19, 2016

(30) Foreign Application Priority Data

Nov. 14, 2014 (JP) ..... 2014231462

(51) Int. Cl.
*G03G 15/16* (2006.01)

(52) U.S. Cl.
CPC ..... *G03G 15/167* (2013.01)

(58) Field of Classification Search
CPC ..... G03G 15/167
See application file for complete search history.

(56) References Cited

U.S. PATENT DOCUMENTS

| | | | | |
|---|---|---|---|---|
| 2010/0142985 | A1 | 6/2010 | Minbe et al. | |
| 2010/0221029 | A1 | 9/2010 | Minbu et al. | |
| 2011/0158690 | A1 | 6/2011 | Mimbu et al. | |
| 2012/0121293 | A1* | 5/2012 | Mimbu | G03G 15/161 399/121 |
| 2013/0223901 | A1 | 8/2013 | Minbe et al. | |
| 2013/0243482 | A1 | 9/2013 | Kato et al. | |
| 2014/0072340 | A1 | 3/2014 | Kato et al. | |
| 2014/0314435 | A1 | 10/2014 | Kato et al. | |
| 2014/0334847 | A1 | 11/2014 | Takahashi et al. | |

FOREIGN PATENT DOCUMENTS

| | | |
|---|---|---|
| JP | 6-274051 | 9/1994 |
| JP | 2013-195875 | 9/2013 |

* cited by examiner

*Primary Examiner* — David Gray
*Assistant Examiner* — Michael Harrison
(74) *Attorney, Agent, or Firm* — Duft Bornsen & Fettig LLP

(57) ABSTRACT

An image forming apparatus includes an image bearer, an image forming device, a transfer member, and a contact-and-separation device. The contact-and-separation device starts a contact operation to move the transfer member to contact the image bearer according to an entry of a recording medium into a transfer nip. The thinner the recording medium, the faster a contacting speed at which the transfer member moves to contact the image bearer. The thicker the recording medium, the slower the contacting speed.

6 Claims, 6 Drawing Sheets

IMAGE FORMING APPARATUS

CROSS-REFERENCE TO RELATED APPLICATION

This patent application is based on and claims priority pursuant to 35 U.S.C. §119(a) to Japanese Patent Application No. 2014-231462, filed on Nov. 14, 2014, in the Japan Patent Office, the entire disclosure of which is hereby incorporated by reference herein.

BACKGROUND

1. Technical Field

Aspects of the present disclosure relate to an image forming apparatus, such as a copier, a printer, and a facsimile machine employing electrophotography.

2. Related Art

An electrophotographic image forming apparatus is known to primarily transfer multiple color toner images onto an intermediate transferor such that the color toner images are superimposed on one another on the intermediate transferor.

Such an image forming apparatus supplies a transfer bias to a recording medium while the recording medium passes between a secondary transfer roller (a transfer member) and an intermediate transferor (an image bearer), thereby secondarily transferring the superimposed toner images formed on the intermediate transferor onto the recording medium.

If the image bearer is in constant contact with the transfer member, a shock jitter occurs due to the impact generated when the recording medium enters and exits, thereby distorting the images. The term "shock jitter" used herein refers to the impact generated by a recording medium contacting an image bearer and transmitted to primary transfer portions between photoconductors and image bearers, thereby shifting the positions of the toner images on the image bearers when they are primarily transferred thereonto.

In order to prevent such shock jitter, the transfer member can be brought into contact with the image bearer as the recording medium passes between them. The image forming apparatus may then further cause the transfer member to separate from the image bearer as the recording medium exits.

However, such an image forming apparatus may exhibit uneven performance with respect to the prevention of shock jitter, the performance varying with the thicknesses of the recording media used.

SUMMARY

In an aspect of this disclosure, there is provided an improved image forming apparatus including an image bearer, an image forming device to form an image on a surface of the image bearer, a transfer member to transfer the image formed on the surface of the image bearer onto a recording medium in a transfer nip formed between the image bearer and the transfer member, and a contact-and-separation device to move the transfer member to contact the image bearer and to separate from the image bearer. The contact-and-separation device starts a contact operation to move the transfer member to contact the image bearer according to an entry of the recording medium into the transfer nip. The thinner the recording medium, the faster a contacting speed at which the transfer member moves to contact the image bearer, and the thicker the recording medium, the slower the contacting speed.

In another aspect of this disclosure, there is provided an image forming apparatus including an image bearer, an image forming device to form an image on a surface of the image bearer, a transfer member to transfer the image formed on the surface of the image bearer onto a recording medium in a transfer nip formed between the image bearer and the transfer member, and a contact-and-separation device to move the transfer member to contact the image bearer and to separate from the image bearer. The contact-and-separation device starts a separation operation to move the transfer member to separate from the image bearer according to an exit of the recording medium from the transfer nip. The thinner the recording medium, the faster a separating speed at which the transfer member moves to separate from the image bearer, and the thicker the recording medium, the slower the separating speed.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
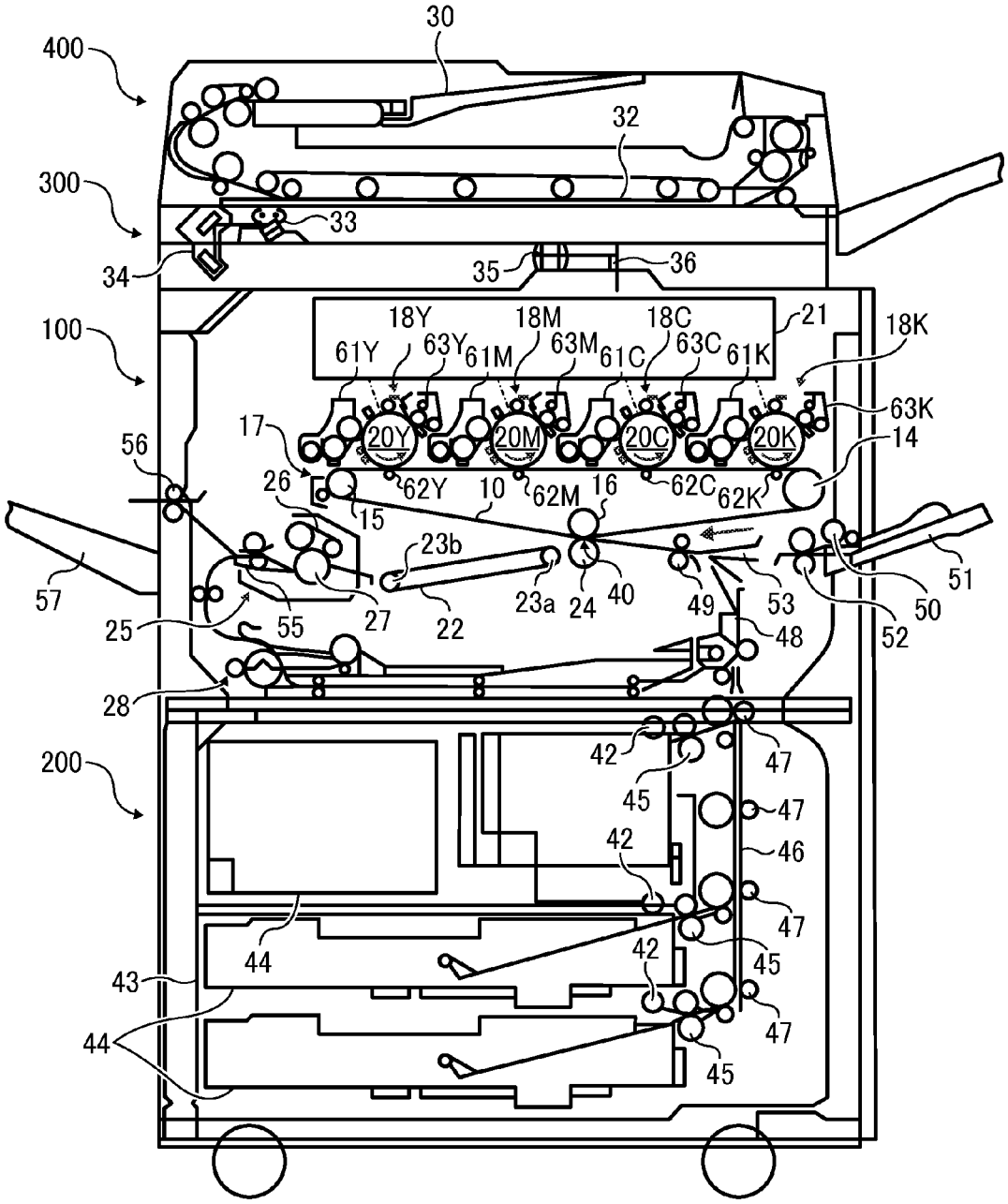
FIG. 1 is a schematic view of a tandem multicolor copier as an example of an image forming apparatus according to an embodiment of the present invention.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components)

having the same function or shape and redundant descriptions thereof are omitted below.

FIG. 1 is a schematic view of a tandem multicolor copier that is an image forming apparatus according to an embodiment of the present invention.

A printer unit 100 includes an intermediate transfer belt 10 formed into an endless loop as an image bearer. The intermediate transfer belt 10 is entrained about and stretched taut between a drive roller 14, a driven roller 15, and a secondary-transfer opposed roller 16 in such a manner that the loop of the intermediate transfer belt 10 looks like an inverted triangle shape as viewed from the side. The drive roller 14 is rotated by a driving device, and the rotation thereof enables the intermediate transfer belt 10 to endlessly travel in a clockwise direction indicated by an arrow. The printer unit 100 includes image forming stations 18Y, 18M, 18C, and 18K for the colors yellow, magenta, cyan, and black, in respective above the loop of the intermediate transfer belt 10 along the traveling direction of the intermediate transfer belt 10. It is to be noted that the suffixes Y, M, C, and K denote colors yellow, magenta, cyan, and black, respectively. To simplify the description, the reference characters Y, M, C, and K indicating colors are omitted herein unless otherwise specified. The image forming stations 18Y, 18M, 18C, and 18K serving as an image forming device forms an image on the surface of the intermediate transfer belt 10.

As illustrated in FIG. 1, the image forming stations 18Y, 18M, 18C, and 18K include photoconductors 20Y, 20M, 20C, and 20K, developing devices 61Y, 61M, 61C, and 61K, photoconductor cleaners 63Y, 63M, 63C, and 63K, respectively. The photoconductors 20Y, 20M, 20C, and 20K contact the intermediate transfer belt 10 to form primary transfer nips between each of the photoconductors 20Y, 20M, 20C, and 20K and the intermediate transfer belt 10. The photoconductors 20Y, 20M, 20C, and 20K are driven to rotate in a counterclockwise direction indicated by an arrow by a driving device while contacting the intermediate transfer belt 10. Each of the developing devices 61Y, 61M, 61C, and 61K develops an electrostatic latent image formed on the photoconductors 20Y, 20M, 20C, and 20K, respectively, by supplying toners of respective colors yellow, magenta, cyan, and black. The photoconductor cleaners 63Y, 63M, 63C, and 63K remove residual toner remaining on the photoconductors 20Y, 20M, 20C, and 20K after a primary transfer process, that is, after the photoconductors 20Y, 20M, 20C, and 20K pass through the primary transfer nips. According to the present illustrative embodiment, the four image forming stations 18Y, 18M, 18C, and 18K arranged along the traveling direction of the intermediate transfer belt 10 constitute a tandem image forming unit.

The printer unit 100 includes an optical writing unit 21 located substantially above the tandem image forming unit. The optical writing unit 21 optically scans the surface of the photoconductors 20Y, 20M, 20C, and 20K rotating in the counterclockwise direction to form electrostatic latent images on the surfaces of the photoconductors 20Y, 20M, 20C, and 20K in optical writing process. Prior to the optical writing process, the surfaces of the photoconductors 20Y, 20M, 20C, and 20K are uniformly charged by charging devices of the image forming stations 18Y, 18M, 18C, and 18K.

A transfer unit includes the intermediate transfer belt 10 and primary transfer rollers 62Y, 62M, 62C, and 62K disposed inside the loop of the intermediate transfer belt 10. The intermediate transfer belt 10 is interposed between the primary transfer rollers 62Y, 62M, 62C, and 62K, and the photoconductors 20Y, 20M, 20C, and 20K. The primary transfer rollers 62Y, 62M, 62C, and 62K pressingly contact the back of the intermediate transfer belt 10 against the photoconductors 20Y, 20M, 20C, and 20K.

A secondary transfer roller 24 serving as a transfer member is disposed below the intermediate transfer belt 10 or outside the loop of the intermediate transfer belt 10. The secondary transfer roller 24 contacts a portion of the front surface or the image bearing surface of the intermediate transfer belt 10 wound around the secondary-transfer opposed roller 16, thereby forming a secondary transfer nip 40 serving as a transfer nip between the secondary transfer roller 24 and the intermediate transfer belt 10. A sheet of recording media (hereinafter, referred to as a recording sheet) is sent to the secondary transfer nip 40 in appropriate timing. In the secondary transfer nip 40, the four-color composite toner image is transferred secondarily from the intermediate transfer belt 10 onto the recording sheet.

The scanner 300 includes a reading device 36, i.e., a reading sensor that reads image information of a document placed on an exposure glass 32. The obtained image information is sent to the controller of the printer unit 100. Based on the image information provided by the scanner 300, the controller (not shown) controls light sources such as a laser diode and a light emitting diode (LED) of the optical writing unit 21 to illuminate the photoconductors 20Y, 20M, 20C, and 20K with light for each color. Accordingly, an electrostatic latent image is formed on the surface of each of photoconductors 20Y, 20M, 20C, and 20K. Subsequently, the electrostatic latent image is developed with toner of each color through developing process into toner images, one for each of the colors yellow (Y), magenta (M), cyan (C), and black (K).

The paper feed unit 200 includes multiple paper cassettes 44, feed rollers 42, separation rollers 45, a sheet passage 46, conveyor rollers 47, and so forth. One of the feed rollers 42 is selectively rotated so as to feed a recording sheet from one of paper cassettes 44 disposed in a paper bank 43. The separation roller 45 separates the recording sheet, which has been fed out of the paper cassette 44, from the stack of recording sheets and feeds it to the sheet passage 46. The conveyor rollers 47 deliver the recording sheet to a sheet passage 48 of the printer unit 100.

In addition to the paper feed unit 200, the recording sheet can be supplied manually using a feed roller 50, a manual feed tray 51 and a separation roller 52. The separation roller 52 picks up and feeds the recording sheet loaded on the manual feed tray 51 to a sheet passage 53 one sheet at a time. The sheet passage 53 meets the sheet passage 48 in the printer unit 100.

A pair of registration rollers 49 is disposed substantially at the end of the sheet passage 48. After the recording sheet delivered along the sheet passage 48 is interposed between the pair of registration rollers 49, the pair of registration rollers 49 feeds the recording sheet to the secondary transfer nip 40 in appropriate timing.

Still referring to FIG. 1, a description is provided of image forming operation for a color image. First, a document is placed on a document table 30 of an auto document feeder (hereinafter simply referred to as ADF) 400 or is placed on an exposure glass 32 of the scanner 300 by opening the ADF 400. When the document is placed on the exposure glass 32, the ADF 400 is closed to hold the document. Then, a start button (not shown) is pressed. In a case in which the document is placed on the document table 30 of the ADF 400, when a start button is pressed, the document is sent onto the exposure glass 32. Subsequently, the scanner 300 is activated, thereby moving a first carriage 33 and a second carriage 34 along the document surface. A light source of the first carriage 33 projects light against the document, which is then reflected on the document. The reflected light is reflected towards the second carriage 34. Mirrors of the second carriage 34 reflect the light towards an imaging lens 35 that directs the light to the reading device 36. The reading device 36 reads the document.

As the printer unit 100 receives the image information from the scanner 300, a recording sheet having an appropriate size corresponding to the image information is supplied to the sheet passage 48. The intermediate transfer belt 10 is rotated endlessly in the clockwise direction by the drive roller 14, which is rotated by a drive motor (not shown). In the meantime, the photoconductors 20Y, 20M, 20C, and 20K of the image forming stations 18Y, 18M, 18C, and 18K are rotated, and the photoconductors 20Y, 20M, 20C, and 20K are subjected to various imaging processes such as charging, optical writing, and development. Through these processes, toner images of yellow, cyan, magenta, and black formed on the surface of photoconductors 20Y, 20M, 20C, and 20K are primarily transferred onto the surface of the intermediate transfer belt 10 in the respective primary transfer nips such that they are superimposed one atop the other, thereby forming a four-color composite toner image on the intermediate transfer belt 10.

In the paper feed unit 200, one of the feed rollers 42 is selectively rotated in accordance with the size of a recording sheet so as to feed the recording sheet from one of paper cassettes 44 disposed in the paper bank 43. The recording sheet picked up by the feed roller 42 is fed to the sheet passage 46 one by one by the separation roller 45. Subsequently, the recording sheet is delivered to the sheet passage 48 in the printer unit 100 by the conveyor rollers 47. When using the manual feed tray 51, a feed roller 50 of the manual feed tray 51 is driven to rotate to pick up the recording sheet loaded on the manual feed tray 51. Then, the separation roller 52 separates and feeds the recording sheet to the sheet passage 53. The recording sheet is delivered to the sheet passage 48. Near the sheet passage 48, the leading end of the recording sheet comes into contact with the pair of registration rollers 49, and delivery of the recording sheet stops temporarily. Subsequently, the pair of registration rollers 49 starts to rotate again to feed the recording sheet to the secondary transfer nip 40 in appropriate timing such that the recording sheet is aligned with the four-color composite toner image formed on the intermediate transfer belt 10 in the secondary transfer nip 40. In the secondary transfer nip 40, due to nip pressure and electric field, the composite toner image is secondarily transferred onto the recording sheet.

The recording sheet, onto which the composite toner image is transferred at the secondary transfer nip 40, is carried on a sheet conveyance belt 22 wound around rollers 23*a* and 23*b* and delivered to a fixing device 25. The fixing device 25 includes a pressing roller 27 and a fixing belt 26 contacting the pressing roller 27 to form a fixing nip therebetween. In the fixing device 25, the composite toner image is fixed on the recording sheet as the recording sheet passes through the fixing nip between the fixing belt 26 and the pressing roller 27 where heat and pressure are applied. After the color toner image is formed on the recording sheet, the recording sheet is output by a pair of output rollers 56 onto a sheet ejection tray 57 disposed at the exterior wall of the printer unit 100.

In the case of duplex printing, after the recording sheet is discharged from the fixing device 25, a switching claw 55 changes the delivery path of the recording sheet to send it to a reversing unit 28. In the reversing unit 28, the recording sheet is turned upside down and returned to the pair of registration rollers 49 to pass through the secondary transfer nip 40 and the fixing device 25 again.

A belt cleaner 17 is disposed outside the loop of the intermediate transfer belt 10 and contacts the intermediate transfer belt 10 upstream from the primary transfer nip for yellow, which is at the extreme upstream end in the primary transfer process among the four colors.

Figure 2:
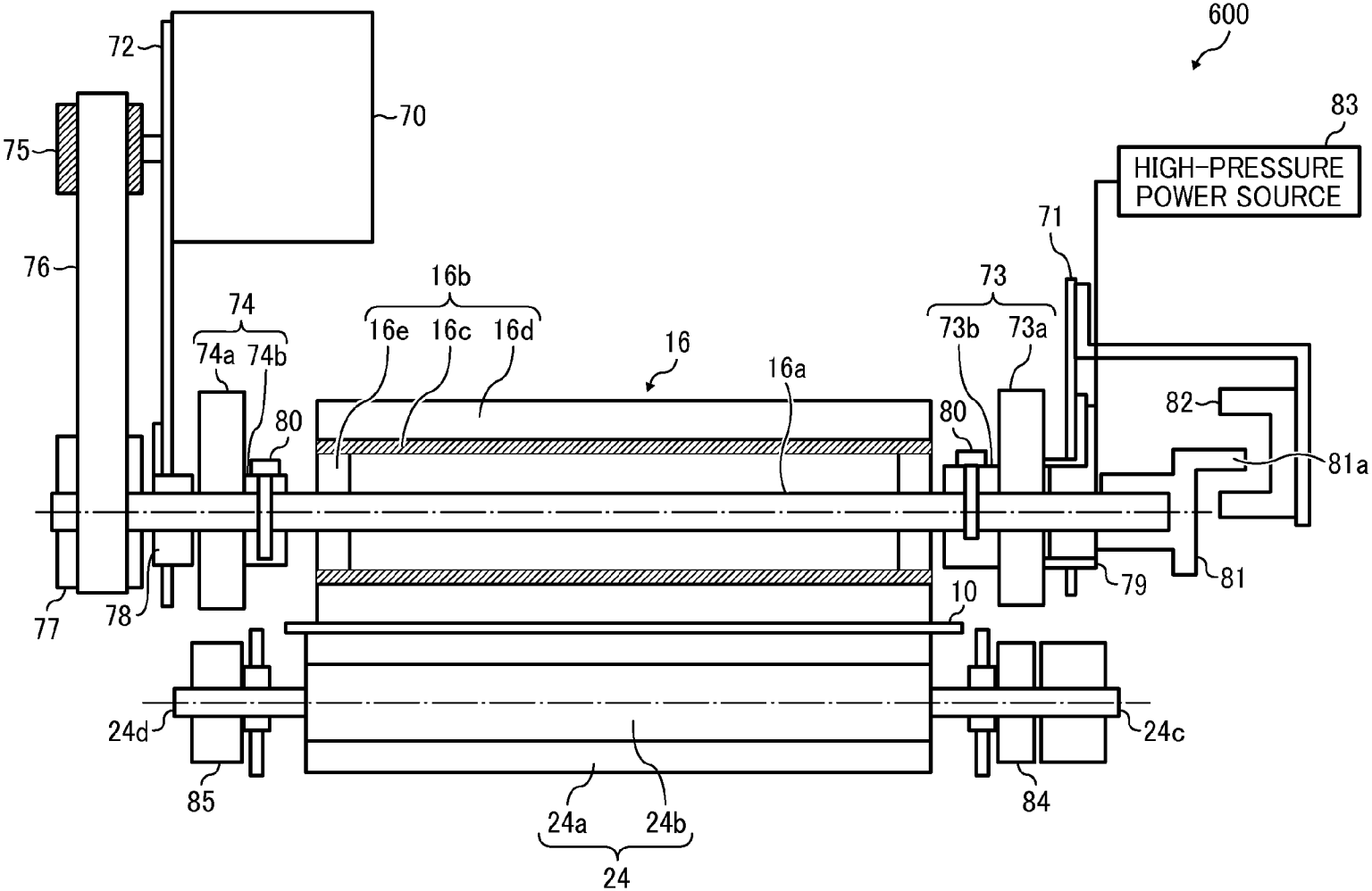
FIG. 2 is a schematic view of an area around a secondary transfer roller where the secondary transfer roller performs a contact-and-separation operation.

FIG. 2 is a schematic view of an area around a secondary transfer roller where the secondary transfer roller performs a contact-and-separation operation;

The secondary transfer roller 24 includes a hollow metal cored bar 24*b*, an elastic layer 24*a* fixed to the circumferential surface of the metal cored bar 24*b*, a first shaft 24*c*, a second shaft 24*d*, a first idler roller 84, and a second idler roller 85. The first shaft 24*c* and the second shaft 24*d* project from each end surface of the secondary transfer roller 24 in the axial direction. The elastic layer 24*a* is formed of elastic material.

The material constituting the metal cored bar 24*b* includes, but is not limited to, stainless steel and aluminum. The elastic layer 24*a* has preferably a hardness of 70° or less on Japanese Industrial Standards (hereinafter, referred to as JIS)-A hardness scale, for example. In a configuration in which a cleaning device such as a cleaning blade contacts the secondary transfer roller 24 to clean the surface thereof, the elastic layer 24*a* which is too soft will cause various problems such as damage. Thus, a desired hardness of the elastic layer 24*a* is 40° or less on JIS-A hardness scale. In a case in which the secondary transfer roller 24 is not equipped with a cleaning blade, the elastic layer 24*a* can be soft, thereby preventing imaging failure caused by stress applied to the secondary transfer nip 40 when the recording sheet enters and exits the secondary transfer nip 40. In view of the above and in terms of productivity, a desired hardness of the elastic layer 24*a* is 40° to 50° on Asker C hardness scale. The conductive rubber material for the elastic layer 24*a* of the secondary transfer roller 24 includes, but is not limited to, conductive epichlorohydrin rubber, Ethylene Propylene Diene Monomer (EPDM) and Si rubber in which carbon is dispersed, nitrile butadiene rubber (NBR) having ionic conductive properties, and urethane rubber. The elastic layer 24*a* fixed on the circumferential surface of the metal cored bar 24*b* is made of conductive rubber with the resistance value thereof adjusted to have a resistance in a range of 6.5 to 7.5 Log Ω.

The electrical resistance of the elastic layer 24*a* is adjusted to a predetermined range to prevent concentration of transfer electric current at a place of contact at which the intermediate transfer belt 10 and the secondary transfer roller 24 come into direct contact with each other without the recording sheet in the secondary transfer nip 40 when a relatively small recording sheet in the axial direction of the roller, such as A5-size, is used. With an electrical resistance of the elastic layer 24*a* greater than the electrical resistance of the recording sheet, the concentration of the transfer electrical current is prevented.

The conductive rubber material for the elastic layer 24*a* includes foam rubber having a hardness ranging from 40° to 50° on Asker C hardness scale. With this configuration, the elastic layer 24*a* can deform flexibly in a thickness direction in the secondary transfer nip 40, thereby making the secondary transfer nip 40 relatively wide in a transport direction of the recording sheet. The elastic layer 24*a* has a barrel shape with a center thereof having a larger outer diameter than that of the end portions. With this configuration, the pressure at the center portion of the secondary transfer roller 24 is prevented from decreasing when the secondary transfer roller 24 is pressed against the intermediate transfer belt 10 by a coil spring 91 (shown in FIG. 3) to form the secondary transfer nip 40 and hence the secondary transfer roller 24 is bent.

The secondary transfer roller 24 is pressed against the intermediate transfer belt 10 entrained about the secondary-transfer opposed roller 16. The secondary-transfer opposed roller entraining the intermediate transfer belt 10 includes a cylindrical roller portion 16*b* as a main body and a shaft 16*a*. The shaft 16*a* penetrates through the center of rotation of the roller portion 16*b* in the axial direction while allowing the roller portion 16*b* to rotate idly on the shaft 16*a*. The shaft 16*a* is made of metal and allows the roller portion 16*b* to rotate idly freely on the circumferential surface thereof. The roller portion 16*b* as a main body includes a drum-shaped metal cored bar 16*c*, an elastic layer 16*d*, and a ball bearing 16*e*. The elastic layer 16*d* is fixed on the circumferential surface of the metal cored bar 16*c* and made of elastic material. The ball bearing 16*e* is press fit to both ends of the metal cored bar 16*c* in the axial direction thereof. While supporting the metal cored bar 16*c*, the ball bearings 16*e* rotate on the shaft 16*a* together with the metal cored bar 16*c*. The elastic layer 16*d* is formed on the outer circumferential surface of the metal cored bar 16*c*.

More specifically, the shaft 16*a* is rotatably supported by a first shaft bearing 79 and a second ball bearing 78. The first shaft bearing 79 is fixed to a first lateral plate 71 of the transfer unit that supports the intermediate transfer belt 10 in a stretched manner. The second ball bearing 78 is fixed to a second lateral plate 72. It is to be noted that the shaft 16*a* does not rotate most of the time during a print job. The shaft 16*a* allows the roller portion 16*b* that tries to rotate together with the intermediate transfer belt 10 traveling endlessly by the drive roller 14 to rotate idly on the shaft 16*a*.

The elastic layer 16*d* is formed on the outer circumferential surface of the metal cored bar 16*c* and is made of nitrile butadiene rubber (NBR) that makes the resistance in a range of 7.0 to 8.0 Log Ω.

The rubber material for the elastic layer 16*d* includes nitrile butadiene rubber (NBR) so that the elastic layer 16*d* has a hardness ranging from 48° to 58° on JIS-A hardness scale.

Cams are fixed to both ends of the shaft 16*a* of the secondary-transfer opposed roller 16, outside the roller portion 16*b* in the longitudinal direction thereof. Each of the cams serves as contact parts that come into contact with the secondary transfer roller 24, and is fixed to the shaft 16*a* to integrally rotate together with the shaft 16*a*. More specifically, a first cam 73 is fixed to one end of the shaft 16*a* of the secondary-transfer opposed roller 16 in the longitudinal direction thereof. The first cam 73 includes a cam portion 73*a* and a true-circular roller portion 73*b*. The cam portion 73*a* and the roller portion 73*b* are arranged in the axial direction and constitute a single integrated unit. The roller portion 73*b* includes a parallel pin 80 on the circumferential surface thereof, that penetrates through the shaft 16*a*, thereby fixing the first cam 73 to the shaft 16*a*.

A second cam 74 has the same configurations as that of the first cam 73, and is fixed to the other end of the shaft 16*a* in the longitudinal direction thereof. As in the same manner as the first cam 73, the second cam 74 includes a cam portion 74*a* and a true-circular roller portion 74*b*. The cam portion 74*a* and the roller portion 74*b* are arranged in the axial direction and constitute a single integrated unit.

Furthermore, a power receiving pulley 77 is fixed outside the second cam 74 in the axial direction of the shaft 16*a*. A detection target disk 81 is fixed to the shaft 16*a* outside the first cam 73 and the first shaft bearing 79 in the axial direction of the shaft 16*a*. A cam drive motor 70 is fixed to the second lateral plate 72 of the transfer unit. A motor pulley 75 disposed on the shaft of the cam drive motor 70 is rotated so as to transmit, via a timing belt 76, a driving force to the power receiving pulley 77 fixed to the shaft 16*a*.

With this configuration, the shaft 16*a* is rotated by driving the cam drive motor 70. Even when the shaft 16*a* is rotated, the roller portion 16*b* can rotate idly freely on the shaft 16*a* so that the roller portion 16*b* can rotate together with the belt. A stepping motor is employed as the cam drive motor 70, thereby providing a greater freedom in setting the angle of rotation of the motor without a rotation angle detector such as an encoder.

When the shaft 16*a* stops rotating at a predetermined angle, the cam portion 73*a* of the first cam 73 comes into contact with the first idler roller 84, and the cam portion 74*a* of the second cam 74 comes into contact with the second idler roller 85. The first idler roller 84 and the second idler roller 85 are disposed on the shaft of the secondary transfer roller 24. Subsequently, the first cam 73 and the second cam 74 push the secondary transfer roller 24 against the pressure of the coil spring 91 of a roller unit retainer 90. With this configuration, the distance between the shaft of the secondary-transfer opposed roller 16 and the shaft of the secondary transfer roller 24 is adjusted by moving the secondary transfer roller 24 away from the secondary-transfer opposed roller 16 and the intermediate transfer belt 10.

According to the present illustrative embodiment, the secondary-transfer opposed roller 16 serving as a rotatable support roller; the first cam 73 and the second cam 74 serving as a cam; the cam drive motor 70 serving as a cam driver; the roller unit retainer 90; the first idler roller 84 and the second idler roller 85 serving as an idler member; and so forth constitute a contact-and-separation device 600 that adjusts the distance between the secondary-transfer opposed roller 16 and the secondary transfer roller 24. Additionally, the contact-and-separation device 600 causes the secondary transfer roller 24 to come into contact with the intermediate transfer belt 10, and the secondary transfer roller 24 to be separated from the intermediate transfer belt 10. As described above, the secondary-transfer opposed roller 16 includes the cylindrical roller portion 16*b* and the shaft 16*a* that penetrates through the center of rotation of the roller portion 16*b* such that the roller portion 16*b* can rotate idly on the shaft 16*a*. Rotation of the shaft 16*a* enables the first cam 73 and the second cam 74 fixed to both ends of the shaft 16*a* in the axial direction thereof to rotate together. Thus, the cams at both ends of the shaft 16*a*, that is, the first cam 73 and the second cam 74, can be rotated by providing a power transmission device for transmission of power to the shaft 16*a* only at one end of the shaft 16*a* in the axial direction.

As described above, according to the present illustrative embodiment, the secondary transfer bias having the same polarity as that of the toner is applied to the metal cored bar 16*c* of the secondary-transfer opposed roller 16 while the metal cored bar 24*b* of the secondary transfer roller 24 is grounded. With this configuration, the secondary transfer electric field is formed between the secondary-transfer opposed roller 16 and the secondary transfer roller 24 so that the toner moves electrostatically from the secondary-transfer opposed roller 16 side to the secondary transfer roller 24 side.

In the secondary-transfer opposed roller 16, the first shaft bearing 79 that rotatably supports the shaft 16*a* made of metal is constituted of a conductive slide bearing. For example, the first shaft bearing 79 is constituted of an oil-impregnated bearing. A high-voltage power source 83 is connected to the conductive first shaft bearing 79 to output the secondary transfer bias. The secondary transfer bias output from the high-voltage power source 83 is directed to the secondary-transfer opposed roller 16 via the first shaft bearing 79. The secondary transfer bias is transmitted through the shaft 16*a*, the ball bearings 16*e*, the metal cored bars 16*c*, and the elastic layers 16*d* in this recited order, accordingly. The shaft 16*a*, the ball bearing 16*e*, and the metal cored bar 16*c* are made of metal, and the elastic layer 16*d* is conductive.

The detection target disk 81 fixed to one end of the shaft 16*a* includes a detection target 81*a* on the lateral side thereof. The detection target 81*a* is formed at a portion of the lateral side of the detection target disk 81 in a circumferential direction of the shaft 16*a*, extending outward in the axial direction of the shaft 16*a*. An optical detector 82 is fixed to a detector bracket, which is fixed to the first lateral plate 71 of the transfer unit. While the shaft 16*a* rotates and comes to a predetermined rotation angle range, the detection target 81*a* of the detection target disk 81 enters between a light emitting element and a light receiving element of the optical detector 82, shutting off the optical path therebetween. The light receiving element of the optical detector 82 sends a light receiving signal when receiving light from the light emitting element. Based on the time at which the light receiving signal from the light receiving element is cut off and/or based on a driving amount of the cam drive motor 70 from this time, the controller recognizes the rotation angle position of the cam portion 73*a* and the cam portion 74*a* fixed to the shaft 16*a*.

As described above, the first cam 73 and the second cam 74 fixed to the shaft 16*a* of the secondary-transfer opposed roller 16 come into contact with the first idler roller 84 and the second idler roller 85 at a predetermined rotation angle. The first idler roller 84 and the second idler roller 85 are disposed on the shaft of the secondary transfer roller 24. Subsequently, the first cam 73 and the second cam 74 push the secondary transfer roller 24 against the coil spring 91 back and down in a direction away from the secondary-transfer opposed roller 16. The amount of push down is determined by the rotation angle position of the first cam 73 and the second cam 74. The greater the amount of push down of the secondary transfer roller 24, the greater the distance between the secondary-transfer opposed roller 16 and the secondary transfer roller 24.

The first idler roller 84 is disposed on the first shaft 24*c* of the secondary transfer roller 24 such that the first idler roller 84 can rotate idly. The first idler roller 84 is a ball bearing with an outer diameter slightly smaller than that of the secondary transfer roller 24 and can rotate idly on the circumferential surface of the first shaft 24*c*. The second idler roller 85 having the same configuration as that of the first idler roller 84 is disposed on the second shaft 24*d* of the secondary transfer roller 24 such that the second idler roller 85 can rotate idly.

As described above, the first cam 73 and the second cam 74 fixed to the shaft 16*a* of the secondary-transfer opposed roller 16 come into contact with the first idler roller 84 and the second idler roller 85 at a predetermined rotation angle. More specifically, the first cam 73 fixed to one end of the shaft 16*a* comes into contact with the first idler roller 84 of the secondary transfer roller 24. At the same time, the second cam 74 fixed to the other end of the shaft 16*a* comes into contact with the second idler roller 85 of the secondary transfer roller 24.

Rotation of the first idler roller 84 and the second idler roller 85 is stopped by a frictional force generated when the first idler roller 84 and the second idler roller 85 contact the first cam 73 and the second cam 74 of the secondary-transfer opposed roller 16. However, rotation of the secondary transfer roller 24 is not hindered. Even when rotation of the first idler roller 84 and the second idler roller 85 stops, the first shaft 24*c* and the second shaft 24*d* of the secondary transfer roller 24 can freely rotate independent of the idler rollers which are ball bearings. The rotation of the idler rollers is stopped by the cams contacting the idler rollers. This configuration prevents sliding friction of the cams and the idler rollers, while preventing an increase in the torque of the cam drive motor 70 and the drive motor for the secondary transfer roller 24.

Figure 3:
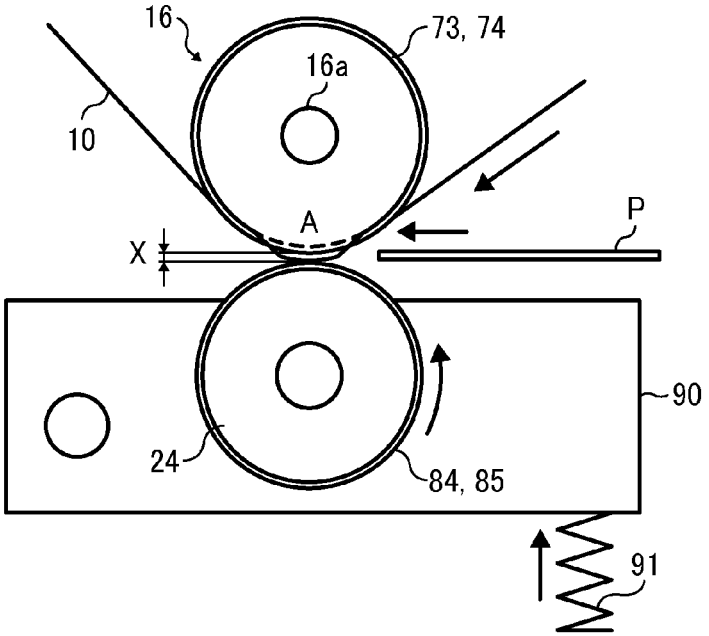
FIG. 3 is a schematic side view of a secondary transfer nip when the secondary transfer roller performs a contact operation.
Figure 4:
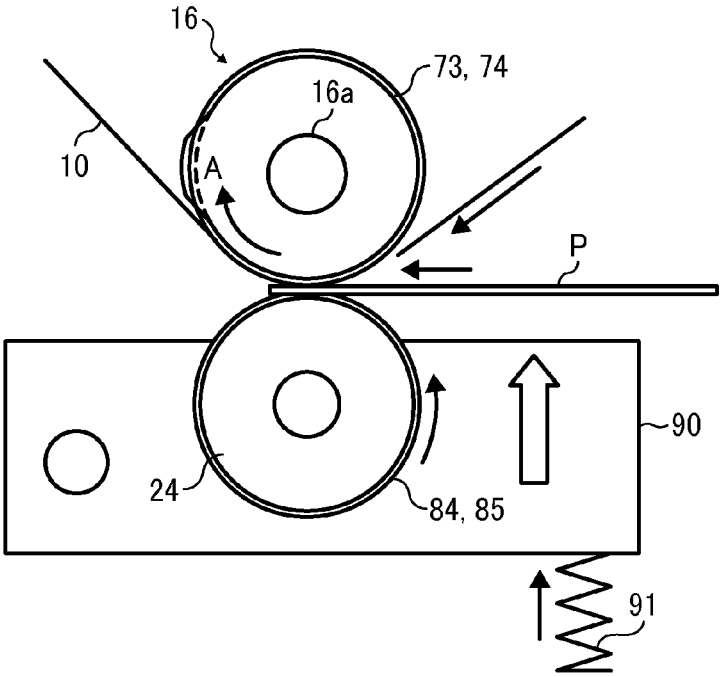
FIG. 4 is a schematic side view of a secondary transfer nip when the secondary transfer roller performs a contact operation.

Each of FIG. 3 and FIG. 4 is a schematic side view of a secondary transfer nip 40 when the secondary transfer roller performs a contact operation;

According to the present illustrative embodiment, a contact-and-separation operation of the secondary transfer roller 24 is carried out by using a contact-and-separation cam. In the present illustrative embodiment, the separation operation is carried out to reduce a shock jitter that occurs when the recording sheet P enters and exits the secondary transfer nip 40 and to prevent contamination of the recording sheet with a test image for adjustment of image density formed between successive recording sheets.

According to the present illustrative embodiment, when the recording sheet P enters the secondary nip, as illustrated in FIG. 3, the rotation of the shaft 16*a* of the secondary-transfer opposed roller 16 is stopped at a position (a cam position A) where the first cam 73 and the second cam 74 come into contact with the first idler roller 84 and the second idler roller 85. That is, when the recording sheet P passes the secondary transfer nip 40, the first cam 73 and the second cam 74 push down the secondary transfer roller 24, thereby forming the space X between the secondary transfer roller 24 and the intermediate transfer belt 10. With this configuration in which the space X is formed between the secondary transfer roller 24 and the intermediate transfer belt 10, even when a recording sheet enters the secondary transfer nip 40 during transfer, a significant load fluctuation does not occur relative to the intermediate transfer belt 10 and the secondary transfer roller 24.

A desired size of the space X between the secondary transfer roller 24 and the intermediate transfer belt 10 is approximately 0.1 mm to 2 mm. However, the size of the space X is not limited to the above-described numerical values.

The cam portion 73*a* of the first cam 73 and the cam portion 74*a* of the second cam 74 and the second cam 74 project from the secondary-transfer opposed roller 16 in a radial direction of the secondary-transfer opposed roller 16, thereby forming the space X between the secondary transfer roller 24 and the intermediate transfer belt 10.

Figure 5:
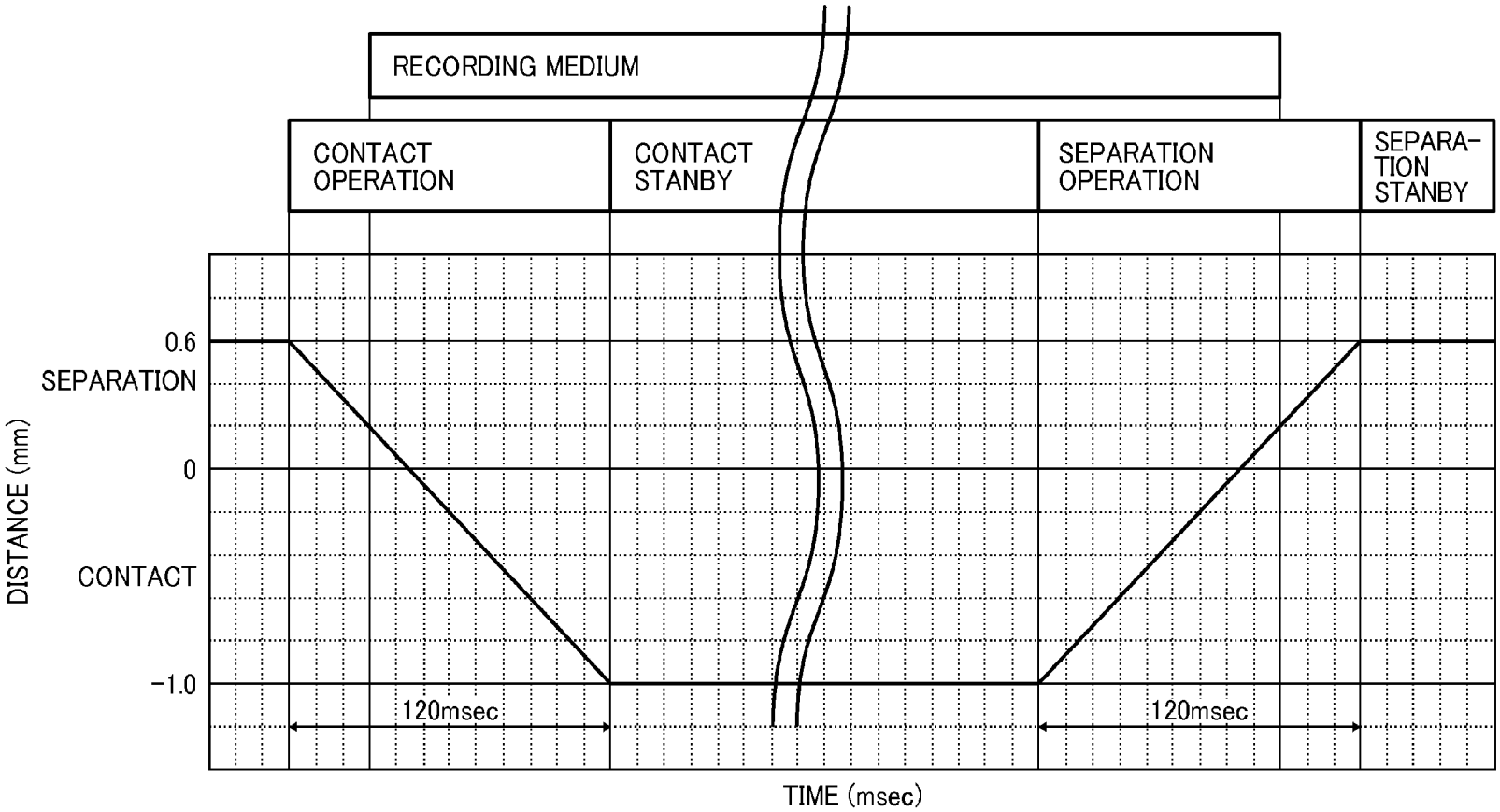
FIG. 5 is a graph of a sequence of a contact-and-separation operation.
Figure 6:
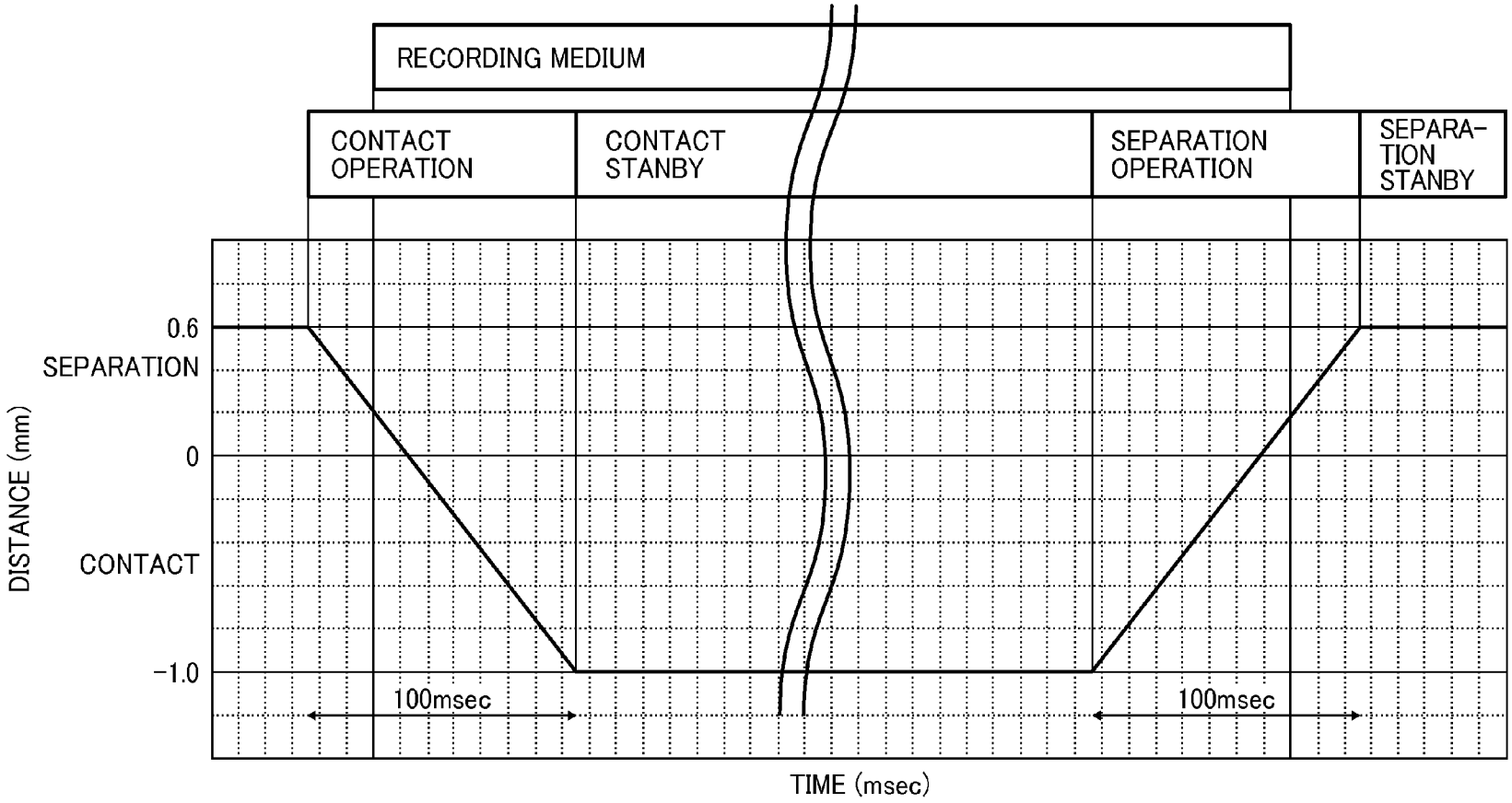
FIG. 6 is a graph of a sequence of a contact-and-separation operation.
Figure 7:
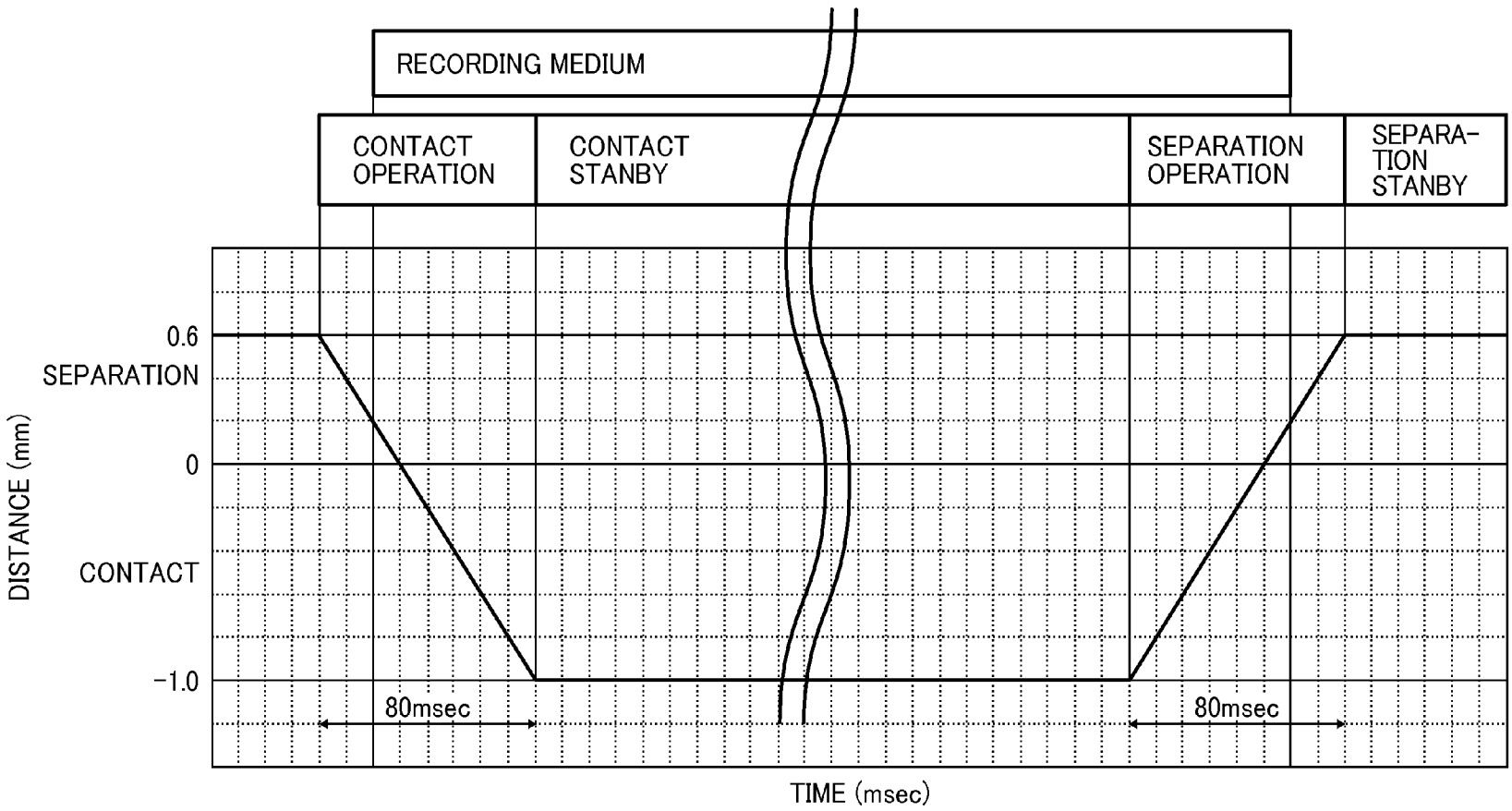
FIG. 7 is a graph of a sequence of a contact-and-separation operation.

Each of FIG. 5, FIG. 6, and FIG. 7 is a graph of a sequence of a contact-and-separation operation of the secondary transfer roller.

FIG. 5 is a graph of a sequence of a contact-and-separation operation of the secondary transfer roller when printing thick paper (a basis weight ranging from 220 g/m$^2$ to 400.0 g/m$^2$). FIG. 6 is a graph of a sequence of a contact-and-separation operation of the secondary transfer roller when printing medium thickness paper (a basis weight ranging from 100 g/m$^2$ to 220 g/m$^2$). FIG. 7 is a graph of a sequence of a contact-and-separation operation of the secondary transfer roller when printing regular paper (a basis weight ranging from 45 g/m$^2$ to 100 g/m$^2$).

In each of FIG. 5, FIG. 6, and FIG. 7, the horizontal axis represents time, and the vertical axis represents the distance X between the secondary transfer roller 24 and the intermediate transfer belt 10. One division in the horizontal axis is 10 msec, and one division in the vertical axis is 0.2 msec. The vertical axis reads positive values while the secondary transfer roller 24 is separated from the intermediate transfer belt 10, and reads negative values while the secondary transfer roller 24 contacts the intermediate transfer belt 10. The distance X is set to 0.6 mm before the recording sheet P enters the secondary transfer nip 40. In each of FIG. 5, FIG. 6, and FIG. 7, according to an entry of the recording sheet P into the secondary transfer nip 40, a contact-and-separation device 600 causes the secondary transfer roller 24 to start a contact operation to come into contact with the intermediate transfer belt 10. The distance X between the secondary transfer roller 24 and the intermediate transfer belt 10 is set to 0.2 mm when the recording sheet P reaches the secondary transfer nip 40. Then, when the first cam 73 and the second cam 74 rotate, the secondary transfer roller 24 starts moving to come into contact with the intermediate transfer belt 10. Such a contact operation is stopped when the distance X is −1.0 mm. The secondary transfer roller 24 is maintained to be in contact with the intermediate transfer belt 10 until the recording sheet P exits the secondary transfer nip 40. That is, the secondary transfer roller 24 and the intermediate transfer belt 10 are kept in a contact-standby state until the recording sheet exits the secondary transfer nip 40.

According to an exit of the recording sheet P from the secondary transfer nip 40, the contact-and-separation device 600 starts a separation operation to separate the secondary transfer roller 24 from the intermediate transfer belt 10. While the recording sheet P exits the secondary transfer nip 40, the distance X between the secondary transfer roller 24 and the intermediate transfer belt 10 is set to 0.2 mm. Then, when the first cam 73 and the second cam 74 rotate, thereby forming a distance X of 0.6 mm, the separation operation is stopped. Then, the secondary transfer roller 24 is maintained to be separated from the intermediate transfer belt 10. That is, the secondary transfer roller 24 and the intermediate transfer belt 10 are in a separation-standby state. The length of time during which the secondary transfer roller 24 is in contact with the intermediate transfer belt 10 depends on the length in a conveyance direction and the linear velocity of the recording sheet P.

Among FIG. 5, FIG. 6, and FIG. 7, a contacting speed, a separating speed, a length of time for a contact operation, and a length of time for a separation operation differ. The contacting speed is a speed at which the secondary transfer roller 24 moves to come into contact with the intermediate transfer belt 10. The separating speed is a speed at which the secondary transfer roller 24 separates from the intermediate transfer belt 10. The length of time for a contact operation is a time length during which the contact operation is carried out to set the secondary transfer roller 24 and the intermediate transfer belt 10 in the contact-standby state. The length of time for a separation operation is a time length during which the separation operation is carried out to set the separation-standby state. Thus, thick paper (a basis weight ranging from 220 g/m$^2$ to 400.0 g/m$^2$) requires 120 msec for each of the contact operation and the separation operation. Medium thickness paper (a basis weight ranging from 100 g/m$^2$ to 220 g/m$^2$) requires 100 msec for each operation. Regular paper (a basis weight ranging from 45 g/m$^2$ to 100 g/m$^2$) requires 80 msec for each operation. These numerical values of time are determined by considering that the greater the thickness of paper, the greater the impact when the recording sheet P enters and exits the secondary transfer nip 40, thereby increasing a shock jitter. For example, when the contact operation in thick paper was completed in 80 msec, which is the same as that in regular paper, a shock jitter occurred. However, when the contact operation of thick paper was carried out at slower speed than the above-described attempt and completed in 120 msec, shock jitter was prevented. In the case of medium thickness paper, a shock jitter was prevented by carrying out the contact operation at a speed that allows the contact operation to be completed in 100 msec. In the case of regular paper, a shock jitter was prevented by carrying out the contact operation at a speed that allows the contact operation to be completed in 80 msec.

Hence, the thinner the recording sheet P, the faster each of the contacting speed and the separating speed. The thicker the recording sheet P, the slower each of the contacting speed and the separating speed. In addition, the thinner the recording sheet P, the shorter each of the length of time for the contact operation and the length of time for the separation operation. In contrast, the thicker the recording sheet P, the longer each of the time lengths. Such a configuration allows a shock jitter to be prevented irrespective of the thicknesses of sheets of paper.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image bearer;

an image forming device to form an image on a surface of the image bearer;

a transfer member to transfer the image formed on the surface of the image bearer onto a recording medium in a transfer nip formed between the image bearer and the transfer member; and a contact-and-separation device to move the transfer member to contact the image bearer and to separate from the image bearer, wherein the contact-and-separation device starts a contact operation to move the transfer member to contact the image bearer according to an entry of the recording medium into the transfer nip, the thinner the recording medium, the faster a contacting speed at which the transfer member moves to contact the image bearer, and the thicker the recording medium, the slower the contacting speed.

2. The image forming apparatus of claim 1, wherein, the thinner the recording medium, the shorter the contact operation, and the thicker the recording medium, the longer the contact operation.

3. The image forming apparatus of claim 1, wherein the contact-and-separation device includes a rotatable support roller, a cam fixed to a shaft of the rotatable support roller, a cam driver to rotate the cam, and an idler member to rotate idly on a shaft of the transfer member, and wherein, the cam comes into contact with the idler member at a predetermined rotation angle.

4. An image forming apparatus comprising:

an image bearer;

an image forming device to form an image on a surface of the image bearer;

a transfer member to transfer the image formed on the surface of the image bearer onto a recording medium in a transfer nip formed between the image bearer and the transfer member; and a contact-and-separation device to move the transfer member to contact the image bearer and to separate from the image bearer, wherein the contact-and-separation device starts a separation operation to move the transfer member to separate from the image bearer according to an exit of the recording medium from the transfer nip, the thinner the recording medium, the faster a separating speed at which the transfer member moves to separate from the image bearer, and the thicker the recording medium, the slower the separating speed.

5. The image forming apparatus of claim 4, wherein the thinner the recording medium, the shorter the separation operation, and the thicker the recording medium, the longer the separation operation.

6. The image forming apparatus of claim 4, wherein the contact-and-separation device includes a rotatable support roller, a cam fixed to a shaft of the rotatable support roller, a cam driver to rotate the cam, and an idler member to rotate idly on a shaft of the transfer member;

wherein, the cam comes into contact with the idler member at a predetermined rotation angle.

* * * * *